US006083044A

United States Patent [19]

Wang et al.

[11] Patent Number: 6,083,044

[45] Date of Patent: Jul. 4, 2000

[54] ELECTRICAL CONNECTOR ASSEMBLY

[75] Inventors: Zhi-Qiang Wang; Zi-Qiang Zhu, both of Kun-Shan, China

[73] Assignee: Hon Hai Precision Ind. Co., Ltd., Taipei Hsien, Taiwan

[21] Appl. No.: 09/384,845

[22] Filed: Aug. 27, 1999

[30] Foreign Application Priority Data

Jul. 6, 1999 [TW] Taiwan ..... 88211237

[51] Int. Cl.[7] ..... H01R 13/73

[52] U.S. Cl. ..... 439/567; 439/541.5

[58] Field of Search ..... 439/541.5, 567, 439/571, 572, 79

[56] References Cited

U.S. PATENT DOCUMENTS 5,336,109 8/1994 Hillbish et al. ..... 439/541.5
5,401,192 3/1995 Briones et al. ..... 439/639
5,643,008 7/1997 Tan et al. ..... 439/541.5
5,800,207 9/1998 Hsu et al. ..... 439/541.5
5,851,125 12/1998 Hsu et al. ..... 439/541.5
5,989,041 11/1999 Lin ..... 439/541.5

*Primary Examiner*—Gary F. Paumen
*Attorney, Agent, or Firm*—Wei Te Chung

[57] ABSTRACT

An electrical connector assembly comprises a frame, first and second electrical connectors mounted on the frame, a pair of board locks and a pair of nuts. Each board lock is symmetrical about a central line thereof, and comprises a mounting portion defining a pair of cutouts in opposite side edges thereof. The cutouts are offset a predetermined distance from the central line. Each nut comprises an expanded portion laterally abutting against one of the side edges of the mounting portion of the board lock thereby mounting the board lock to a side of the frame.

8 Claims, 8 Drawing Sheets

ELECTRICAL CONNECTOR ASSEMBLY

BACKGROUND OF THE INVENTION

The present invention relates to an electrical connector assembly, and especially to an electrical connector assembly having a pair of board locks manufactured in the same machine tool and adapted for being mounted on either side of the electrical connector assembly.

U.S. Pat. Nos. 5,336,109; and 5,401,192 disclose electrical connector assemblies each comprising an electrical connector and a pair of board locks. The board locks are mounted on opposite sides of the electrical connector and engage with a printed circuit board thereby retaining the electrical connector on the printed circuit board.

Referring to FIG. 1, a conventional electrical connector assembly 100 comprises an electrical connector 110, a pair of board locks 120 and a pair of nuts 130. The electrical connector 110 and the board locks 120 each define through holes (not labeled) through which the nuts 130 extend to retain the board locks 120 on the electrical connector 110. However, since the through hole of the board lock 120 is positioned in a central line thereof, the board locks 120 are not suitable for engaging with through holes of the electrical connector 110 which are offset a distance from through holes 601 of a printed circuit board 60.

Referring to FIG. 2, a similar conventional electrical connector assembly 200 comprises an electrical connector 210, a pair of board locks 220 and a pair of nuts 230. The electrical connector 210 defines a pair of through holes (not labeled) which are offset a distance from through holes 601' of a printed circuit board 60'. The board lock 220 forms an lateral projection 221 and defines a through hole (not labeled) therein which is offset the same distance as the distance between the through holes of the electrical connector 210 and a central line of the board lock 220. However, the board locks 220 are not identical and are manufactured in different machine tools, thereby increasing costs. Furthermore, each board lock 220 is only suitable for being mounted to a corresponding side of the electrical connector 210 and is not suitable for being mounted on the other side of the electrical connector 210. Thus, it is not convenient to mount the board locks 220 to the electrical connector 210. Hence, an improved electrical connector assembly is required to overcome the disadvantages of the prior art.

BRIEF SUMMARY OF THE INVENTION

An object of the present invention is to provide an electrical connector assembly having a pair of board locks for mounting the electrical connector assembly onto a printed circuit board, the board locks being manufactured in the same machine tool and being suitable for being mounted on either sides of the electrical connector assembly.

Accordingly, an electrical connector assembly comprises a frame, first and second electrical connectors mounted on the frame, a pair of board locks and a pair of nuts. Each board lock is symmetrical about a central line thereof, and comprises a mounting portion defining a pair of cutouts in opposite side edges thereof. The cutouts are offset a predetermined distance from the central line. Each nut comprises an expanded portion laterally abutting against one of the side edges of the mounting portion of the board lock thereby mounting the board lock to a side of the frame.

Other objects, advantages and novel features of the invention will become more apparent from the following detailed description of the present embodiment when taken in conjunction with the accompanying drawings.

DETAILED DESCRIPTION OF THE INVENTION

Figure 1:
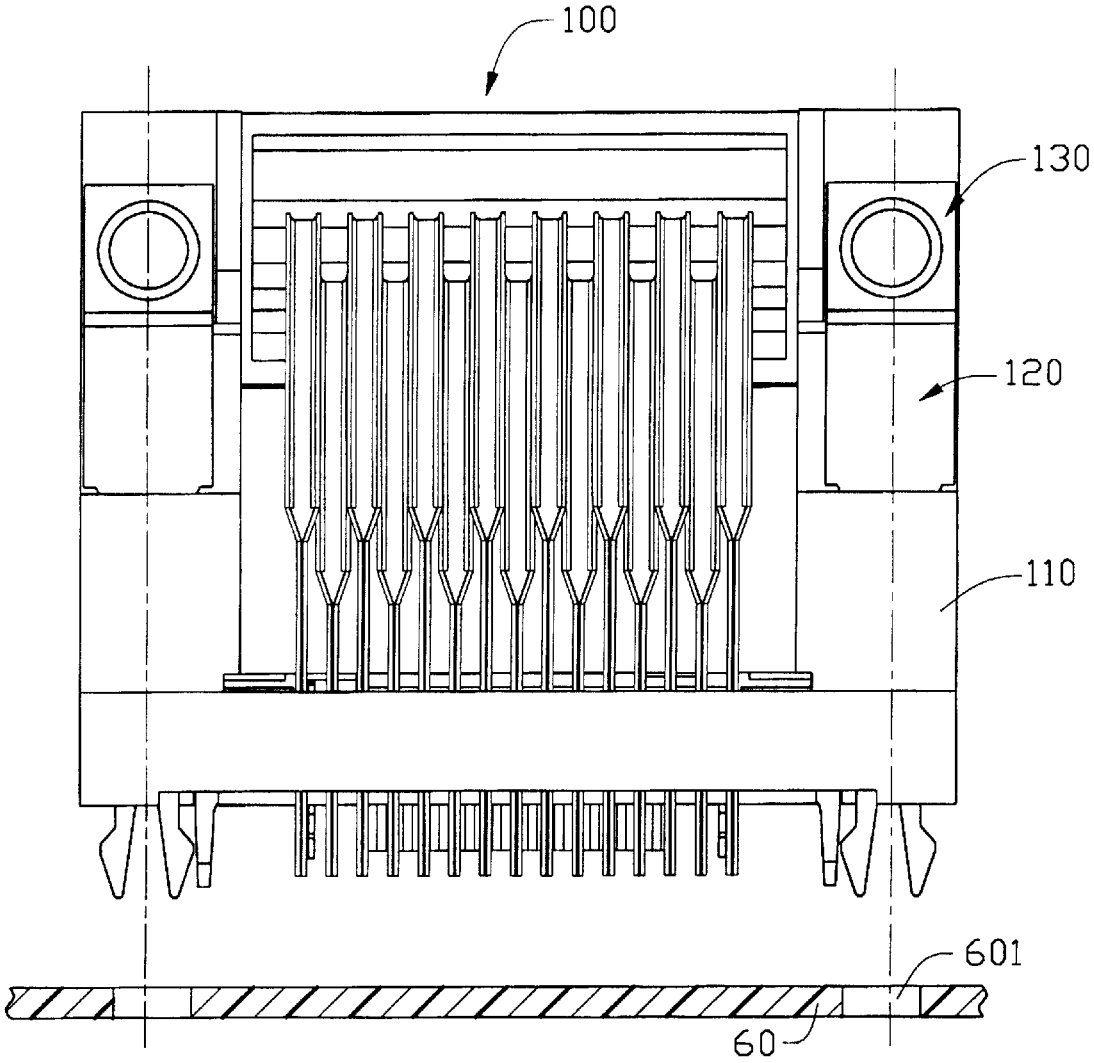
FIG. 1 (PRIOR ART)
FIGS. 1 and 2 are rear views of conventional electrical connector assemblies.
Figure 2:
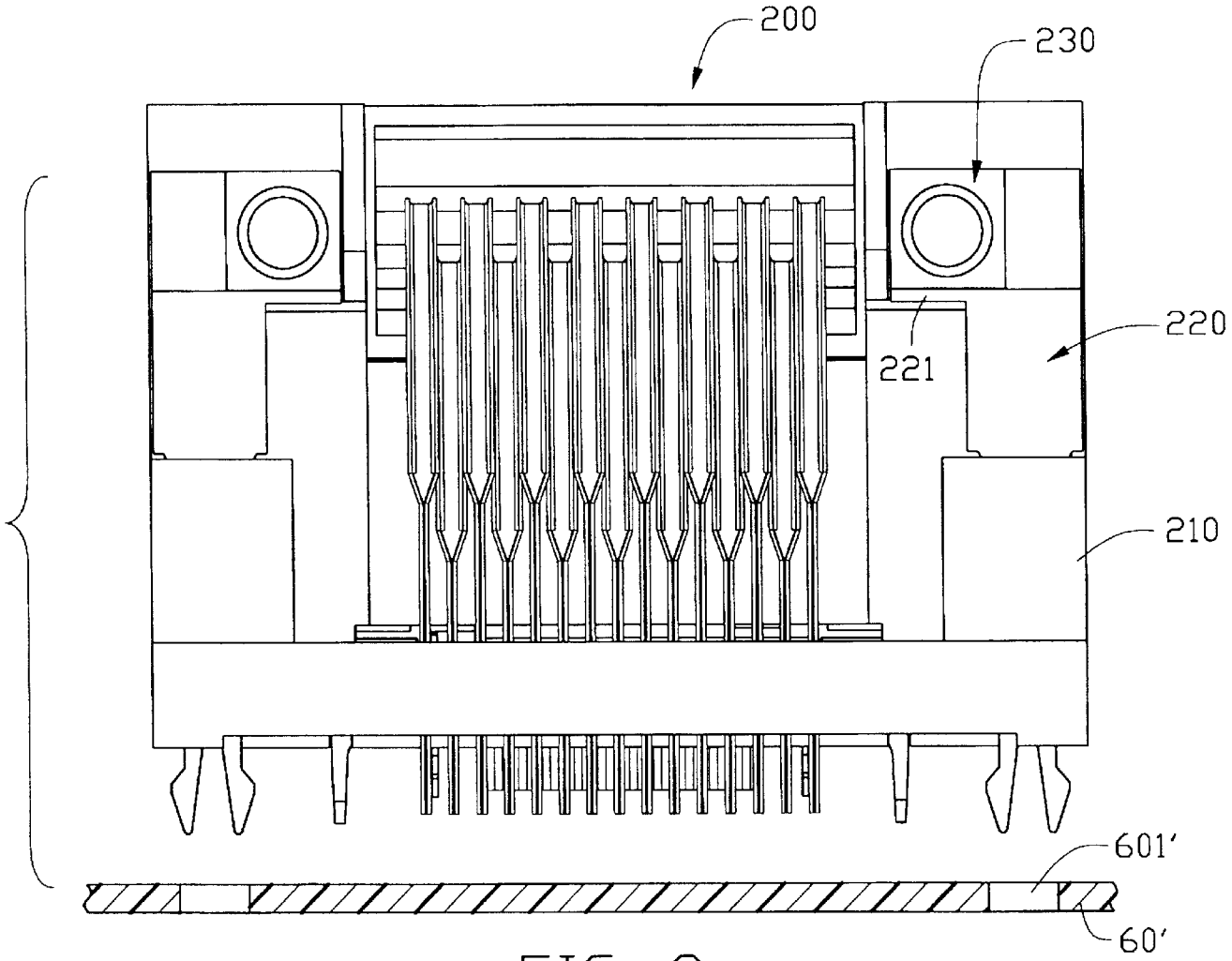
FIG. 2 (PRIOR ART)
Figure 3:
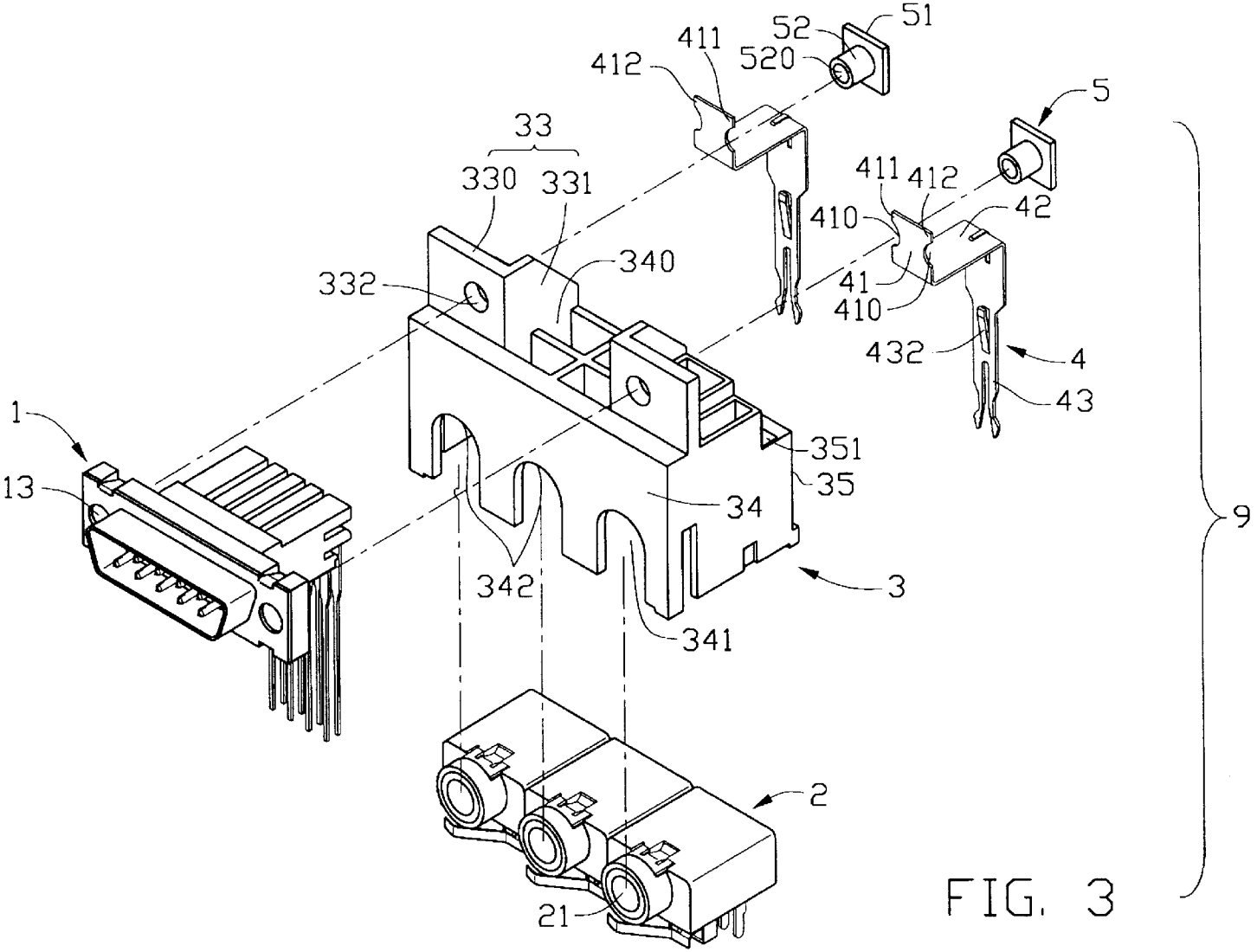
FIG. 3 is an exploded view of an electrical connector assembly in accordance with a first embodiment of the present invention.
Figure 4:
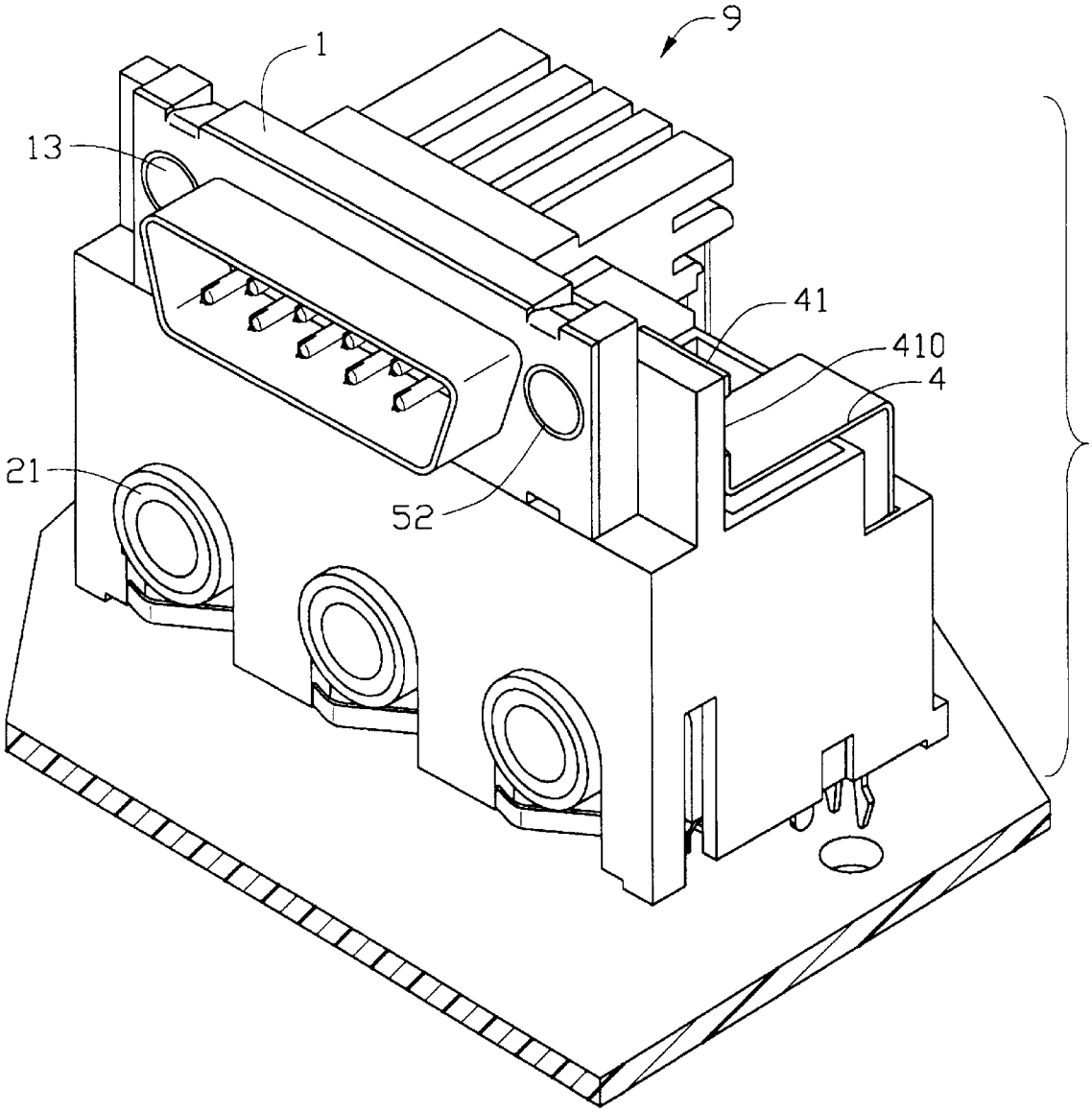
FIG. 4 is a perspective view of the assembled electrical connector assembly of FIG. 3 and a printed circuit board.

Referring to FIGS. 3 and 4, an electrical connector assembly 9 in accordance with a first embodiment of the present invention comprises a frame 3, first and second electrical connectors 1, 2 mounted on the frame 3, a pair of board locks 4 and a pair of nuts 5. The frame 3 provides a pair of L-shaped stations 33 proximate opposite ends of a top portion thereof with a space 340 defined therebetween. Each station 33 comprises a first wall 330 and a second wall 331 perpendicular to the first wall 330. Each first wall 330 defines a through hole 332. The frame 3 comprises a front wall 34 and a rear wall 35, and defines a chamber 341 therebetween. The front wall 34 defines three arcuate recesses 342. The rear wall 35 defines a pair of through channels 351 in opposite edges thereof. The first electrical connector 1 is received in the space 340 of the frame 3. The first electrical connector 1 defines a pair of through holes 13 corresponding to the through holes 332 of the frame 3. The second electrical connector 2 is received in the chamber 341 of the frame 3 with mating portions 21 thereof being received in the corresponding arcuate recesses 342 of the frame 3.

Figure 5:
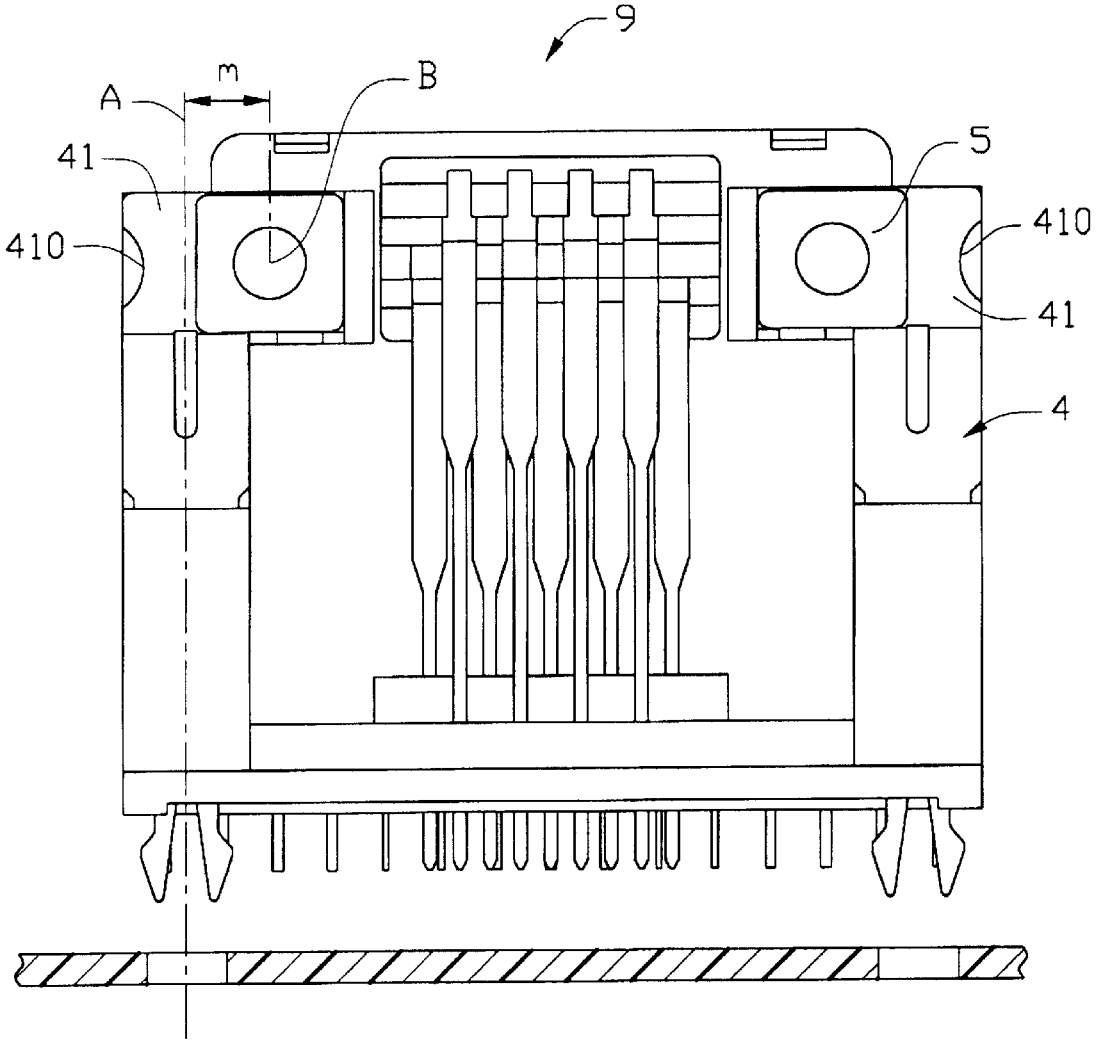
FIG. 5 is a rear view of FIG. 4.

Each board lock 4 comprises an L-shaped supporting portion 42, a mounting portion 41 perpendicularly extending from an edge of the supporting portion 42 and a lock portion 43 downwardly extending from the supporting portion 42. The lock portion 43 forms a blade 432 inwardly stamped therefrom. The mounting portion 41 defines a pair of arcuate cutouts 410 in opposite side edges 411, 412 thereof. Each arcuate cutout 410 is offset a distance from a central line "A" of the board lock 4 (FIG. 5). Each nut 5 comprises a cylindrical portion 52 and an expanded portion 51 positioned at an end of the cylindrical portion 52. The board locks 4 are downwardly assembled to the frame 3 with the lock portions 43 partially retained in the through channels 351 of the frame 3, the blades 432 abutting against peripheries of the through channels 351, and the mounting portions 41 abutting against the first walls 330. The nuts 5 are then forwardly assembled to the frame 3 with the cylindrical portions 52 partially received in the arcuate cutouts 410 and the through holes 332, 13. The expanded portions 51 securely abut against the edges 411 and free ends 520 of the columnar portions 52 are riveted to the first electrical connector 1 thereby assembling the first electrical connector 1, the frame 3 and the board locks 4 together.

Referring to FIG. 5, the board lock 4 is symmetrical about the central line "A" thereof and centers "B" of the through holes 332, 13 are offset a distance "m" from the central line "A". Since the board locks 4 mounted to opposite sides of the frame 3 are identical, they can be manufactured in the same machine tool and the stored together. In operation, the board lock 4 can be attached to either side of the frame 3. Thus, the board locks 4 are manufactured at a low cost and are easily assembled to the frame 3.

Figure 6:
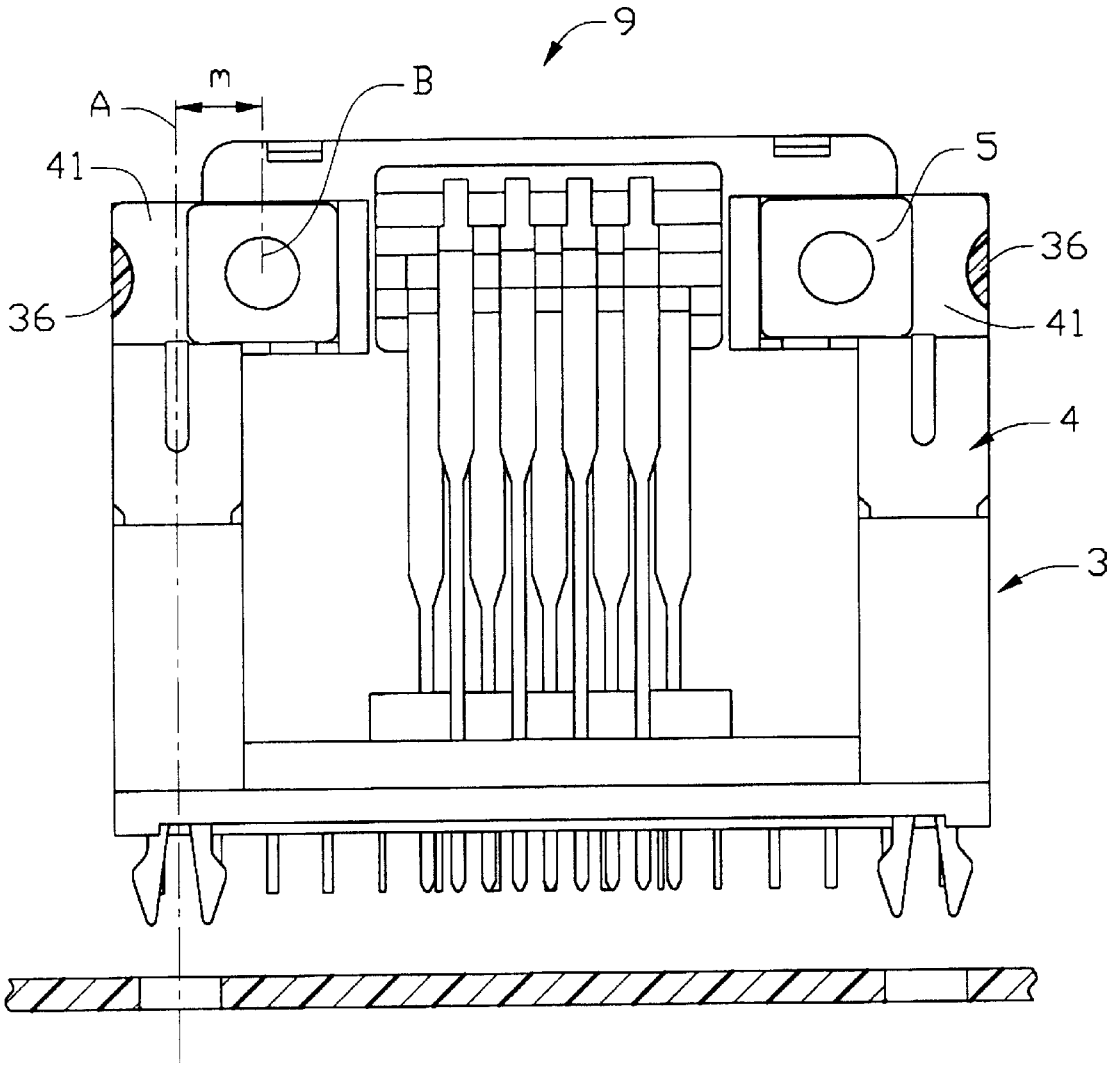
FIG. 6 is a rear view of an electrical connector assembly in accordance with a second embodiment of the present invention.

Referring to FIG. 6, a second embodiment of the present invention is illustrated. The frame 3 provides a projection 36 beside the side edge 412 of the mounting portion 41 of each board lock 4. The projection 36 is received in the cutout 410 and prevents movement of the side edge 412, thereby further retaining the board locks 4 on the frame 3.

Figure 7:
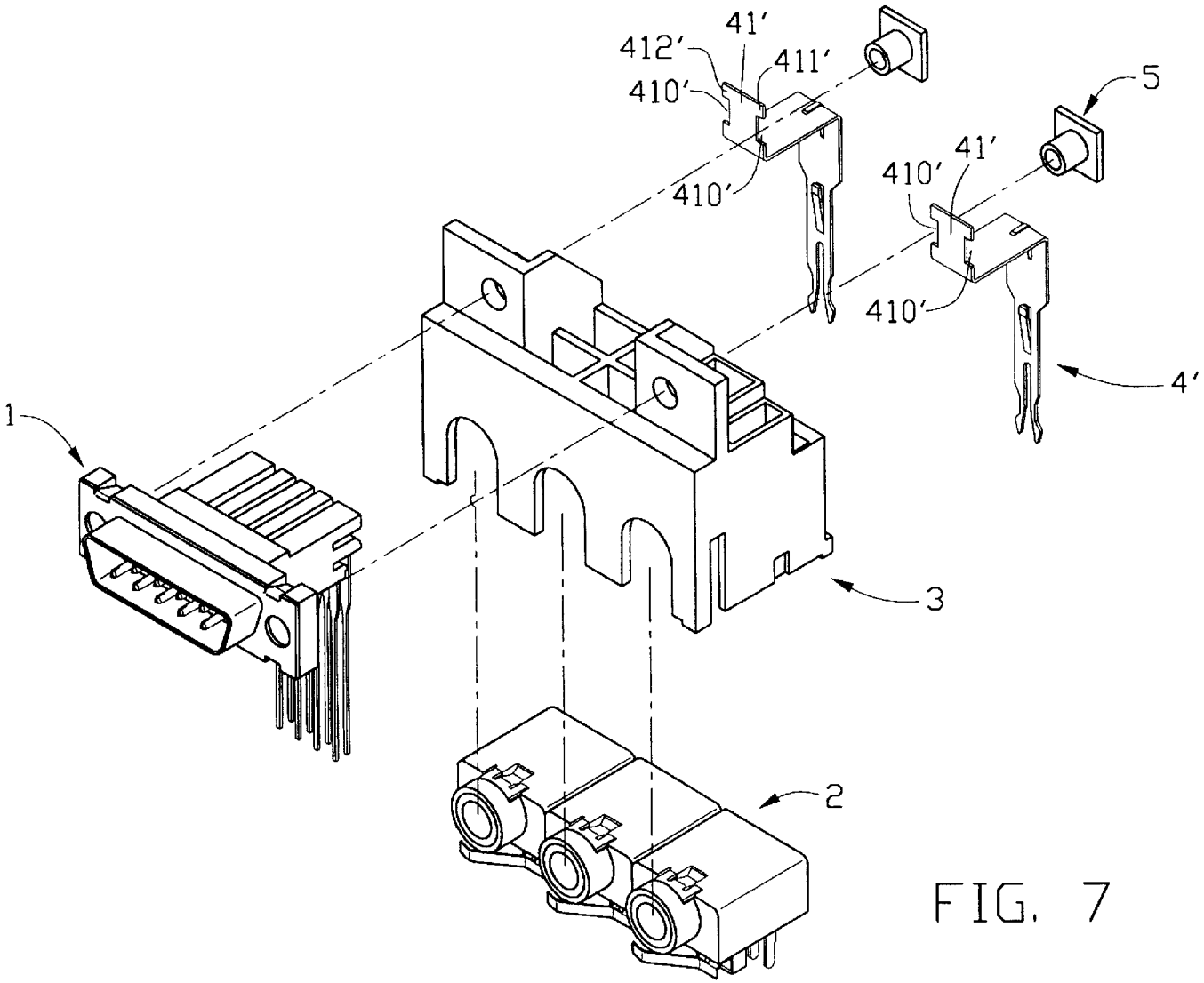
FIG. 7 is an exploded view of an electrical connector assembly in accordance with a third embodiment of the present invention.
Figure 8:
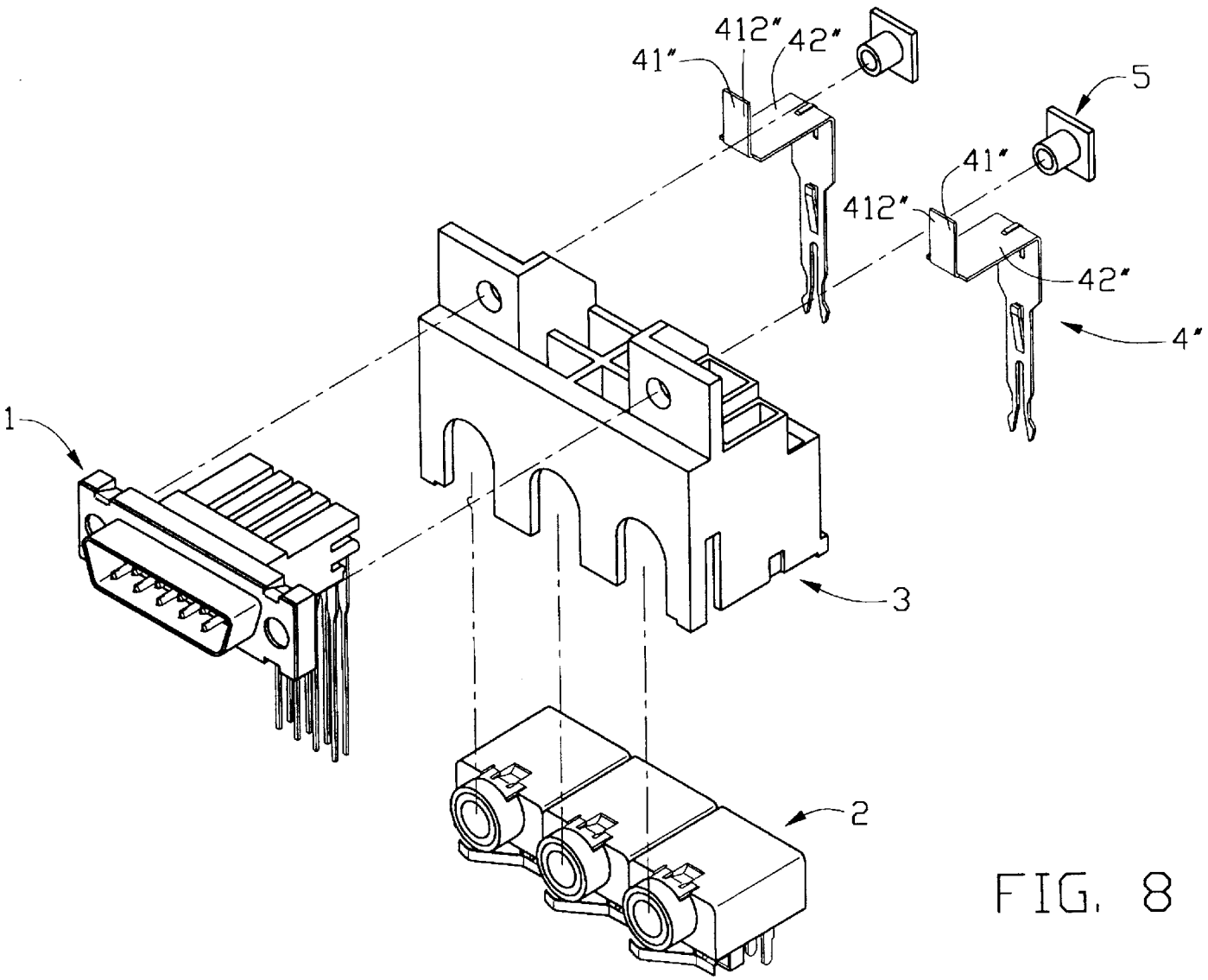
FIG. 8 is an exploded view of an electrical connector assembly in accordance with a fourth embodiment of the present invention.

Referring to FIGS. 7 and 8, third and fourth embodiments of the present invention are illustrated, respectively. The third and fourth embodiments of the present invention are identical to the first embodiment of the present invention except that mounting portions 41', 41" of board locks 4', 4" are different than the mounting portions 41 of the board locks 4. The mounting portion 41' defines a pair of rectangular cutouts 410' in opposite side edges 411', 412' thereof. The mounting portions 41" are narrower than the supporting portions 42" and the nuts 5 abut against the side edges 412".

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a frame defining an electrical connector receiving space and a pair of through holes proximate opposite sides thereof;

an electrical connector received in the space of the frame, the electrical connector defining a pair of through holes aligned with the through holes of the frame;

a pair of board locks each comprising a mounting portion and a lock portion, the mounting portion defining a pair of recesses on opposite side edges thereof, each board lock having a central line and the recesses being offset a predetermined distance from the central line, the board locks being symmetrical about the central line; and a pair of nuts each comprising a cylindrical portion and an expanded portion, each cylindrical portion extending through one of the recesses of the mounting portion of a corresponding board lock and corresponding through hole of the frame and the electrical connector, with the expanded portion pressing a corresponding side edge of the mounting portion of the board lock against the frame, thereby securing the board lock to the frame.

2. The electrical connector as claimed in claim 1, wherein the recess of the mounting portion of the board lock is an arcuate cutout.

3. The electrical connector as claimed in claim 1, wherein the recess of the mounting portion of the board lock is a rectangular cutout.

4. The electrical connector as claimed in claim 1, wherein the board lock comprises a supporting portion between the mounting portion and the lock portion, the mounting portion being narrower than the supporting portion.

5. The electrical connector as claimed in claim 1, wherein the frame has a projection proximate the side edge of the mounting portion of each board lock and distanced from the expanded portion of the nut, the projection being received in the recess of the mounting portion and engaging with a periphery of the recess.

6. An electrical connector assembly comprising:

a connector;

a printed circuit board on which the connector is seated;

said connector defining a pair of first through holes adjacent to two opposite ends thereof, said printed circuit board defining a pair of second through holes, a distance between said pair of first through holes is smaller than that between said pair of second through holes;

a pair of identical board locks positioned adjacent to said two opposite ends of the connector, respectively, each of said board locks comprising a mounting portion and a locking portion for being respectively coupled to the corresponding first through hole and second through hole; and a pair of nuts coaxially extending through the corresponding first through holes, respectively; wherein the mounting portion of each of said board locks which is generally aligned with the locking portion thereof, is positioned on an outer side of the corresponding first through hole and nut while pressed for retention by an outer side portion of said nut.

7. The connector assembly as claimed in claim 6, wherein the mounting portion of each of said board locks further defines a recess in an inner side thereof, and a cylindrical portion of the corresponding nut extends therethrough.

8. A method for assembling a connector unto a printed circuit board, comprising steps of:

providing the connector with a pair of first through holes defining a first distance therebetween;

providing the printed circuit board with a pair of second through holes defining therebetween a second distance being larger than the first distance;

providing a pair of identical board locks adjacent two opposite ends of the connector, each of said board locks defining a mounting portion and a locking portion aligned with each other; and providing a pair of nuts respectively extending through the corresponding first through holes; wherein the mounting portion of each of said board locks is positioned by an outer side of the corresponding nut and only an outer side portion of said nut abuts against the mounting portion of said corresponding board lock.

* * * * *